United States Patent [19]

Faulkner

[11] 4,083,286

[45] Apr. 11, 1978

[54] ELECTRONIC ORGAN KEYING SYSTEMS

[76] Inventor: Alfred H. Faulkner, 1324 Portesuello Ave., Santa Barbara, Calif. 93105

[21] Appl. No.: 675,853

[22] Filed: Apr. 12, 1976

[51] Int. Cl.[2] ..... G10H 1/02

[52] U.S. Cl. ..... 84/1.26; 84/1.13; 84/1.01; 84/1.24

[58] Field of Search ..... 84/1.01, 1.03, 1.12, 84/1.13, 1.24, 1.26

[56] References Cited

U.S. PATENT DOCUMENTS

| | | | |
|---|---|---|---|
| 3,516,321 | 6/1970 | Harris | 84/1.13 |
| 3,819,844 | 6/1974 | Isii | 84/1.26 |
| 3,969,969 | 7/1976 | Clark, Jr. et al. | 83/1.26 |
| 3,999,457 | 12/1976 | Michel | 84/1.13 X |
| 4,014,238 | 3/1977 | Southard | 84/1.13 |

*Primary Examiner*—Ulysses Weldon

[57] ABSTRACT

The circuits described herein are particularly applicable to organs using multiple pitch divider type note generators that are implemented in LS1 form, since one of the aims of the improvements is to reduce the pin count of the LSI chips required in these organs. One such circuit is a synchronizing system used to phase corresponding notes generated in different chips over a single multiplexed buss. Another multiplexed buss is used to identify the lowest octave in use for each note of the chromatic scale. A new touch response circuit employs a digital to analog converter to eliminate the need for capacitors used in previously described fully analog type circuits thereby eliminating many pins. This circuit furthermore enables a superior relation of key velocity to signal level to be obtained which makes practical a wider dynamic gradation of sound. A new digital mechanization of the debounce filters used to overcome chatter of the keyboard contacts eliminates the need for filter capacitors previously employed, thereby saving many pin connections. A new keyer circuit synthesizes sine waves with fewer high value resistors, eliminates the need for filter capacitors to prevent cross modulation, and enables both sine waves and saw tooth waves to be synthesized with a common set of logic elements. Lastly, an improved envelope generator changes the effective envelope time constants inversely with the pitch of the selected note by means of variable duty cycle charging circuits.

6 Claims, 9 Drawing Figures

CONTROL-1

SYNCHRONIZER-1

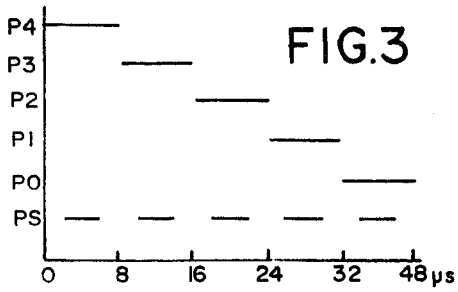
FIG.3
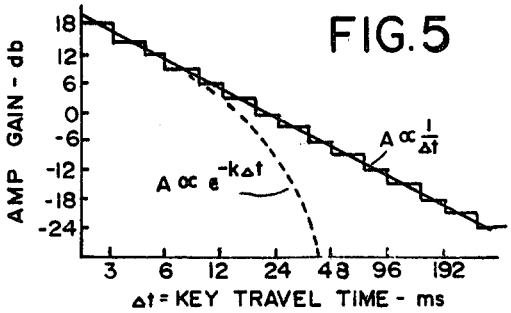
FIG.5
FIG. 4
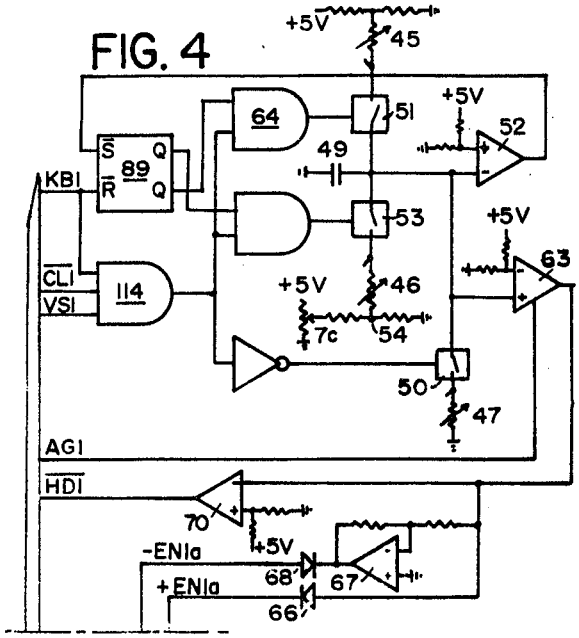
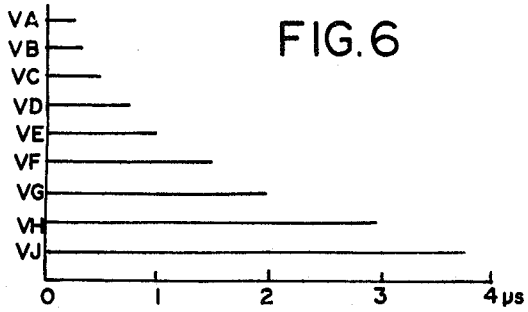
FIG.6
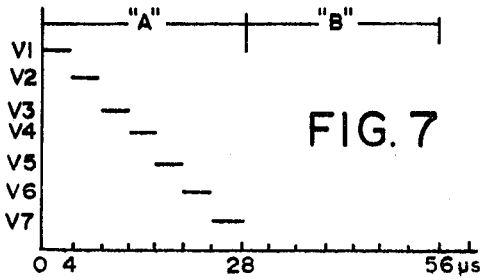
FIG. 7
FIG.8
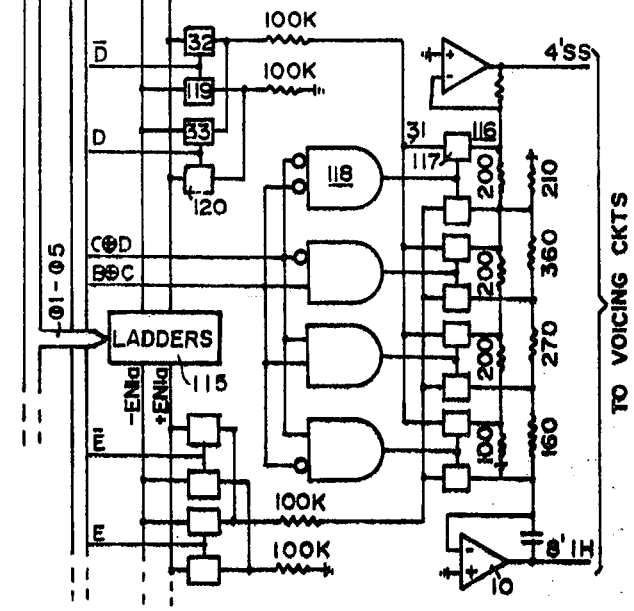
FIG.9
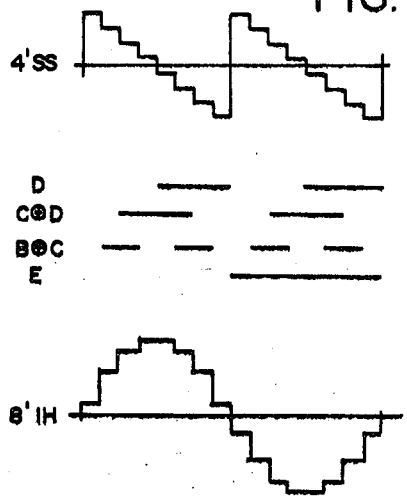

ELECTRONIC ORGAN KEYING SYSTEMS

CROSS REFERENCES

The present invention comprises several improvements in the control circuits, envelope generators, and keyers of the note generators described in my copending applications entitled "Electronic Organ with Multiple Pitch Note Generators," Ser. No. 610,773, filed Sept. 5, 1975, now U.S. Pat. 4,038,096 and "Electronic Organ Keying System," Ser. No. 610,772, filed Sept. 5, 1975.

SUMMARY OF THE INVENTION

The multiple pitch note generators described previously use a normally inactive binary divider chain that operates on demand at various rates to produce selected notes. When a second generator is started to produce a corresponding note, it must be phased with the operating generator before the newly selected note is keyed on to avoid cancellations and undesired transients. Furthermore, when a third generator is started to produce yet another corresponding note it must be phased with the lowest pitched one of the operating generators. Since each of these generators may be one of a set of seven with each set being implemented on a separate LSI chip, it is essential that the number of interchip connections required to effect this phasing, or synchronizing, be minimized. The system described herein requires only two pins on each chip. The corresponding pins of all chips are connected together to form a pair of two way communication channels between chips. All operating generators transmit a pulse train in one of 60 time slots on one channel to identify the note being produced and its octave interval. The generators operating in the lowest octave interval for each note transmit a synchronizing pulse in one of 12 time slots, corresponding to the chromatic scale, on the second channel. The information sent over the first channel is used to determine which generators transmit synchronizing pulses on the second channel.

The new touch response circuit uses a binary counter to measure the travel time of a playing key and a resistive ladder network to convert this time interval into a gain control voltage for an amplifier in the envelope generator output. The outputs of the counter stages represent a geometric progression of time intervals. The attenuation of the ladder network between successive inputs and the output follows another geometric progression. The combination of these two geometric progressions in cascade results in a linear relation between the logarithmic gain, i.e., gain in db, and the logarithm of the playing key travel time. In other words, the ladder output voltage is a linear function of the average velocity of the playing key while it is being depressed.

The digital debounce filter uses a shift, or Johnson, a counter that is normally at zero and in the load "1" mode. The counter shifts once in response to the initial closure of a key contact and latches itself to a pulse source independently of the contacts until a predetermined count is reached. At that point the mode is changed to load "0" and the pulse source is inhibited by the closed contacts, which have had time to reach a steady state. Subsequent opening of the contacts causes the pulse source to drive the counter to the normal zero state. The first stage of the counter provides the filtered output signal.

The improved keyer has a single high value resistor that is switched between the + and − envelope control signals at the fundamental rate to produce an alternating square wave current source that is switched to several different low value load resistors to synthesize the desired waveform. The logic that performs the latter switching can be used to synthesize sawtooth and sine waves simultaneously. A second high value resistor is switched between the + and − envelope control signals at the fundamental rate in complementary relation to the first resistor to maintain a constant load on the envelope control busses and thereby prevent cross-modulation between keyers.

The attack and decay rates of musical instruments generally vary as a function of pitch. The attack of organ pipes, for example, typically spans about seven cycles. One of the modifications of the envelope generator described in the aforementioned copending applications has a common set of variable ADSR resistors that are coupled to capacitors individual to each envelope generator by a set of multiplexed switches in each generator. One of the objects of this modification is to reduce the pin count of the LSI chips. The improvement described herein goes one step further and provides for individual variation of the duty cycle of the sets of multiplexed switches in each envelope generator in accordance with the pitch of the note being produced. The effective value of the ADSR resistors varies inversely with the duty cycle of the multiplexed switches, whereby the attack and decay rates of conventional musical instruments is simulated more faithfully.

BRIEF DESCRIPTION OF THE DRAWINGS

FIGS. 1, 2 and 4 are schematic diagrams of the control, synchronizer and envelope generator sections, respectively, of a typically note generator, FIG. 3 is a timing diagram showing the relation between a series of pulses that appear at times in a multiplex channel to identify the lowest octave interval in which each chromatic scale note is being sounded, FIG. 5 is a graph showing the characteristics of the improved touch response circuit in comparison with the original circuit described in the prior applications referred to above, FIG. 6 is a timing chart showing the relation between a series of pulses of varying duty cycle used to change the envelope generator time constants in accordance with the pitch of the note being sounded, FIG. 7 is a timing chart showing the relation between a series of pulses involved in multiplexing a common set of ADSR controls to the seven individual note generators in each of two sets, FIG. 8 is a schematic diagram of a dual keyer that synthesizes a 4' sawtooth wave and an 8' sine wave simultaneously, and FIG. 9 is a graph showing the waveforms produced by the dual keyer of FIG. 8 together with the square wave inputs to the keyer.

Figure 2:
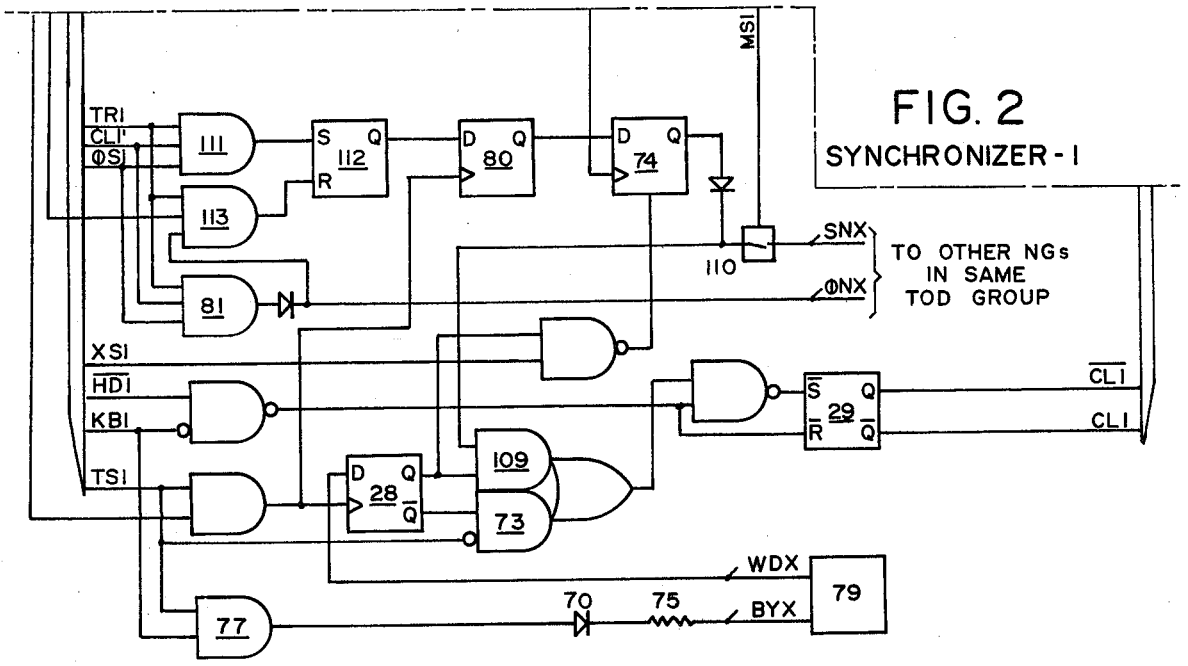
Figure 1:
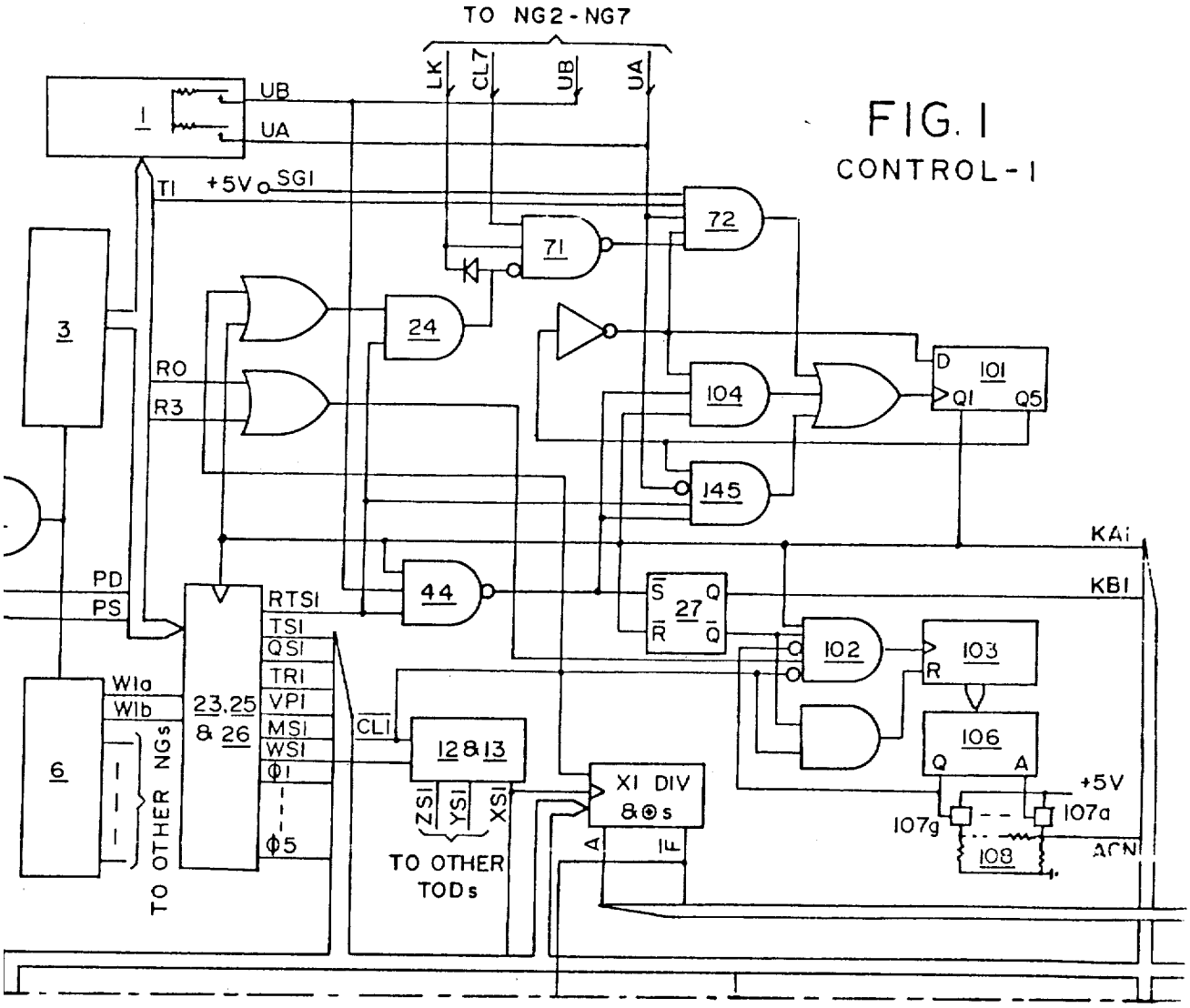
Figure 2:
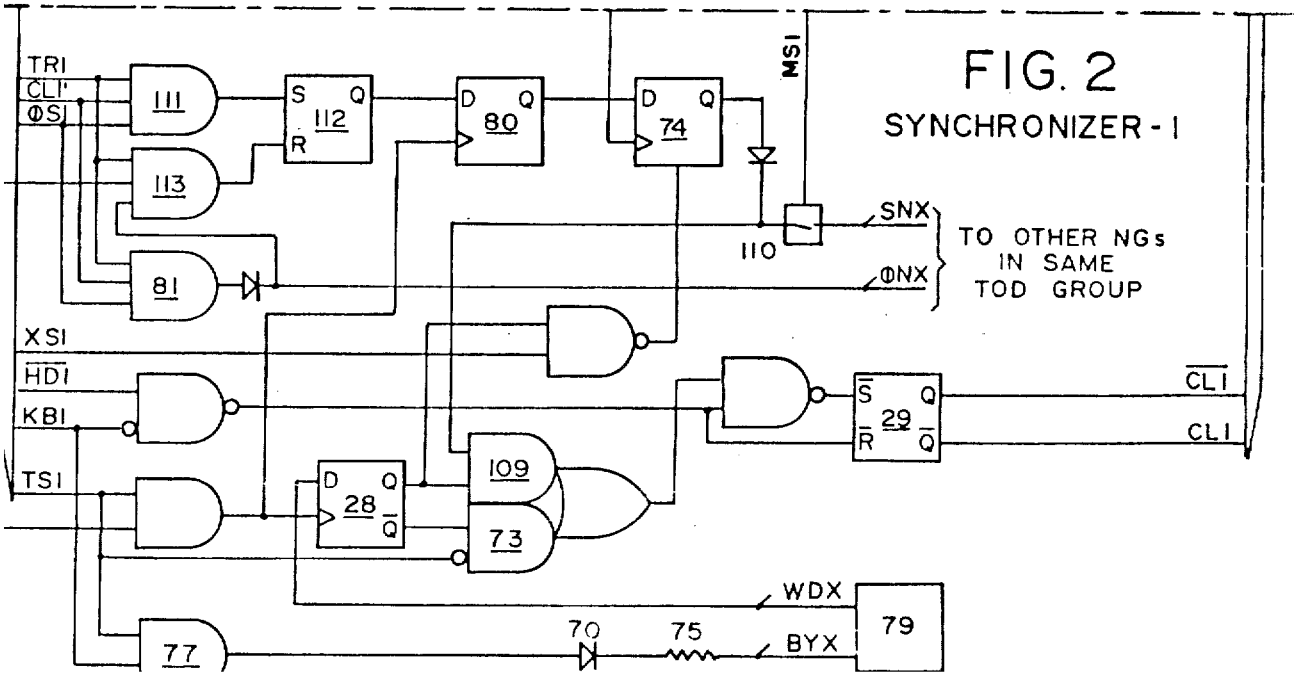

By placing FIGS. 2 and 8 side by side a unitary drawing of a complete note generator is obtained.

DESCRIPTION OF THE ILLUSTRATED EMBODIMENT

General Description of Operation

The embodiment chosen to illustrate the improvements of the invention is a full size organ in which a small number of note generators; each comprising a binary divider, a group of keyers, and an envelope generator; serves an entire keyboard. Each note generator is selectively operable by multiplexed signals from a keyboard to produce either of two adjacent notes in any octave interval. Six of these note generators are provided in each of two sets for each manual of a full size organ. A seventh note generator, which is selectively operable to produce any of the notes available from the other six, is provided in each set together with selection circuitry which causes the seventh note generator to augment any one of the six which is called upon to produce two adjacent, or two octavely related, notes simultaneously. The pitch of all notes is determined by a set of top octave dividers which drive the binary dividers individual to each note generator. Synchronizing circuitry is provided to control the phase relation between binary dividers, when they are driven by a common source, to avoid cancellation effects.

A group of keyers in each note generator includes a number that act as sine wave synthesizers to produce outputs which are practically devoid of low order harmonics. The residual high order harmonics are eliminated by integration, allowing these keyer outputs to be used for additive synthesis of desired tone timbres. Two additional binary dividers are provided in each note generator to obtain third, fifth and sixth harmonics with these keyers. Some of these keyers serve a dual purpose in being arranged to synthesize a sawtooth wave in addition to the sine wave. The sawtooth wave is pitched one octave about the sine wave produced by the dual keyer. Other keyers simply key square waves at octavely related footages. The tone signals from these keyers are combined and filtered to produce various voice qualities selectable by stop switches in a conventional manner.

All of the keyers are controlled by envelope generators which provide for independent control of attack, decay and release times by common variable resistors which are multiplexed to an individual capacitor for each note generator. The multiplex duty cycle of each channel is altered in accordance with the pitch of the note selected to vary the ADR time constants accordingly. A voltage controlled amplifier, or VCA, is used to couple each capacitor to the corresponding group of keyers. The amplifier control voltage is varied by a digital timer and a digital-to-analog converter, or DAC, that is responsive to the key velocity to provide a touch responsive action.

To facilitate understanding of the relation between the present invention and that previously described, corresponding elements in the present and in the copending applications referred to earlier bear like reference characters. However, elements herein which bear reference characters above 100 do not have a correspondingly designated element in the copending applications. In the following detailed description, the emphasis is placed on the improvements introduced in the revised embodiment and the prior applications are relied on for a fuller description of the previously disclosed circuitry.

Timing Generator

Figure 1:
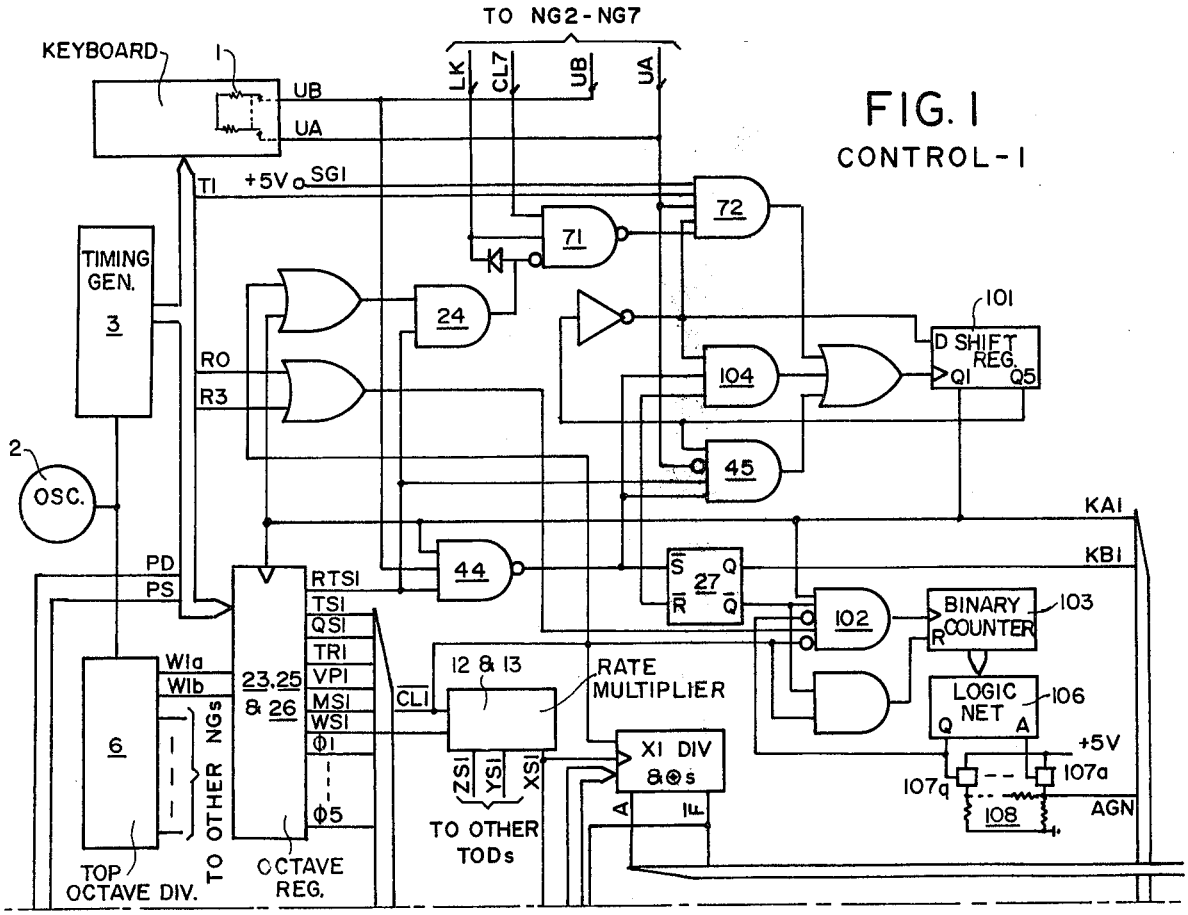

The timing generator 3 in FIG. 1 is represented by a single block, but may actually be distributed and duplicated in part on each of the several LSI chips it serves. One or two pins per chip is sufficient to synchronize and phase such subdivisions of the generator. As described in the prior applications, timing generator 3 produces five pulse trains, PA-PD and TA at 25 khz, six pulse trains T1-T6 with duty cycles of 1/6 and periods of 480 μs, and six pulse trains R0–R5 with duty cycles of 1/6 and periods of 2880 μs. In addition, the following pulses are produced to support the improvements described hereinafter. Twelve pulse trains **M1*a*–M6*b*, corresponding to T1*a*–T1*b* but having durations of 0.5 μs and being spaced 0.5 μs apart; five pulse trains, P0–P4, having repetition rates of 25 khz, and PS, having a repetition rate of 125 khz, all having the duty cycles and timing relationships depicted in FIG. 3; nine pulse trains VA–VJ, having repetition rates of 250 khz and the duty cycle and timing relationship depicted in FIG. 6; and seven pulse trains V1–V7, having periods of 56 μs and the duty cycle and timing relationship depicted in FIG. 7. The V1–V7 pulses appear in either of two 28 μs frames, identified as the "A" set and "B" set in FIG. 7, corresponding to the two sets of note generators associated with each manual. These chips are identical internally, the distinction between "A" and "B" sets being accomplished by appropriate connection of a dedicated pin, or by a unique initial condition of multipurpose pins, as commonly practiced in the LSI art. The staggered 28 μs frames of seven pulses each enable the 14** note generators of the two sets to be controlled by one set of ADSR controls, as described hereinafter.

Keyboard Interface

The keyboard represented by block 1 in FIG. 1 is the same type as the spinet keyboard described fully in my copending application, but is a full length keyboard of 61 notes. Consequently the keyboard receives six octave interval pulse trains, R0–R5, together with the 12 note pulse trains, **T1*a*–T6*b*, from the timing generator 3**; whereby each key is identified by a corresponding note pulse train on output UA occurring in a corresponding octave interval when the key is depressed about ¼ of its full stroke. A like pulse train appears on the second output UB when the playing key is depressed about ¾ of its full stroke. The delay between the first pulse on UA and the first pulse on UB is used to measure the average key velocity, as described hereinafter.

Note Generator Control

FIG. 1 shows the control circuit details of one of seven identical circuits. Control-1 is assigned to the T1 pair of time slots, correponding to notes C# and D. Assuming that key C#3 is depressed, the first pulse on UA occurring at **T1*a*·R3 time sets the first stage Q1 of shift register 101 which clocks the octave register 23 making φ3** alone true.

The block designated 23, 25 and 26 represents the octave register plus associated logic gates which select several pulse trains in accordance with the octave interval, φ1–φ5, stored in the register. RTS1 is a pulse train coincident with the one on UA that initiated the operation of 101, TS1 is a pulse train that recurs at 2.08 khz in the selected T1 time interval assigned to NG1, φS1 is concurrent with TS1 but is a narrow pulse (8μs) occurring in one of five sub-intervals corresponding to the octave interval of the selected note, TR1 is a pulse train like TS1 but leads it by one time slot (40μs), VP1 is a 250 khz pulse train selected from a subset of the group VA–VJ (FIG. 6) in accordance with the octave interval of the selected note, MS1 is a pulse train similar to TS1 but recurring 40 times faster (83.3 khz), and WS1 is the selected one of the two top octave inputs **W1*a* and W1*b***.

RTS1 becomes true immediately after $\phi 3$ is selected, causing the output of gate 24 to become high cyclically at T1*a*·R3 time. Lead LK is consequently driven true cyclically at T1*a*·R3 time to lockout other note generators to the T1*a*·R3 pulse train on UA. Flip-flop 25 (included in the block designated 23, 25 and 26) is also clocked by the true output of 101 (Q1) and is consequently true because its input TA is true at this time. Select gate 26 is set accordingly to select the W1*a* top octave signal together with timing signal TA. The 101(Q1) true state enables gate 102 to clock binary counter 103 at 1.44ms intervals, using the octave interval pulses R0 and R3, to initiate timing of the playing key travel time. The RTS1 pulse train is transmitted by gates 104 and 105 to the clock input of 101 to maintain its shifting operation independently of the coincident pulse train on UA. Output 101(Q5) becomes true with the fourth pulse, 11.5ms after 101(Q1), which drives the D input of 101 low so as to load zeroes in subsequent shift operations, inhibits 104 to prevent further independent shifting, and inhibits 72 while enabling 145 so that further shift operations are dependent on the absence of coincident pulses on UA and RTS1. When the second contacts on the playing key close, the first resulting pulse on UB drives the output of gate 44 low, setting flip-flop 27 which stops further counting by 103.

The eight stages of 103 are connected to logic gates 106 which are arranged to select 15 switches, 107*a*-107*q*, one at a time in accordance with the following truth table.

| SWITCH | Δt-ms | A | B | C | D | E | F | G | H |
|---|---|---|---|---|---|---|---|---|---|
| 107a | <3 | X | 0 | 0 | 0 | 0 | 0 | 0 | 0 |
| 107b | 3–4.5 | 0 | 1 | 0 | 0 | 0 | 0 | 0 | 0 |
| 107c | 4.5–6 | 1 | 1 | 0 | 0 | 0 | 0 | 0 | 0 |
| 107d | 6–9 | X | 0 | 1 | 0 | 0 | 0 | 0 | 0 |
| 107e | 12–9 | X | 1 | 1 | 0 | 0 | 0 | 0 | 0 |
| 107f | 12–18 | X | X | 0 | 1 | 0 | 0 | 0 | 0 |
| 107g | 18–24 | X | X | 1 | 1 | 0 | 0 | 0 | 0 |
| 107h | 24–36 | X | X | X | 0 | 1 | 0 | 0 | 0 |
| 107j | 36–48 | X | X | X | 1 | 1 | 0 | 0 | 0 |
| 107h | 48=72 | X | X | X | X | 0 | 1 | 0 | 0 |
| 107l | 72–96 | X | X | X | X | 1 | 1 | 0 | 0 |
| 107m | 96–144 | X | X | X | X | X | 0 | 1 | 0 |
| 107n | 144–192 | X | X | X | X | X | 1 | 1 | 0 |
| 107p | 192–288 | X | X | X | X | X | X | 0 | 1 |
| 107q | >288 | X | X | X | X | X | X | 1 | 1 |

These switches connect +5V to corresponding inputs of the ladder network 108. All of the series elements of the ladder have the same value R, all of the shunt elements except the last have the value 2R, and the last shunt element has the value 3R. There is one shunt element for every two series elements. With these values the voltage output is halved (−6db) for every second input selection. The intermediate steps provide −3.6db reduction, whereby the approximation shown in FIG. 5 to a continuous slope of −6db for each twofold increase in travel time is obtained. A series of current sources, much as those used in current summing type DACs, may be used in lieu of the resistive ladder network, if desired.

Note Generator Synchronizer

Referring now to FIG. 2, flip-flop 28 was set in accordance with the state of signal WDX when timing pulse TA was gated to lead TS1 in Control-1. Assuming there are no other generators producing this note in any octave interval, there is only one input to busy signal lead BYX and hence the WDX output of majority gate 79 is false at this time. Flip-flop 28 is consequently set false causing the X1 divider (FIG. 1), and also the Y1 and Z1 dividers (shown in the previously identified prior applications), to be started immediately in response to the subsequent closure of the second key contact. At the end of the TA time period during which KB1 became true, TS1 going false causes flip-flop 29 to be set making $\overline{CL1}$ true. Signal $\overline{CL1}$ holds the X1, Y1 and Z1 dividers in the zero state when it is false. Now when it goes true, all three dividers start counting with the next pulse on their respective inputs. Keyers are permanently connected to the dividers and the pitch produced is determined by changing the division ratio at the top end of the dividers. All of the dividers provide true and false signals from each stage and exclusive-or signals from adjacent stages to the keyers described in a later section.

In order to explain the synchronizing operation, it will now be assumed that some other note generator is already sounding a note that is octavely related to the C♯3 note that has just seized NG1. In this case there are at least two inputs to majority gate 79 at TS1 time, hence WDX is true at this time which causes flip-flop 28 to be clocked true with the rise of TS1·PD. Gate 73 is consequently disabled and 109 is enabled, whereby flip-flop 29 does not get set until a synchronizing pulse from the operating C♯ note generator appears on SNX. This pulse is coincident with operation of the switch 110 by the MS1 pulse train. All three dividers in NG1 start from the zero state when 29 is set, as described above.

With $\overline{CL1}$ true gate 111 sets flip-flop 112 with the rise of P1 (FIG. 3) in time slot TR1 (which is T6*b* in this example). There are three conditions to consider, i.e., the operating note generator is in an octave interval >NG1, =NG1, or <NG1. In the first instance, the pulse transmitted to $\phi$NX by the other note generator will precede P1, hence 112 will be true at the end of TR1. In the second instance; 112 will be an ambiguous state during the PS portion (FIG. 3) of P1, when both gates 111 and 113 have true outputs; but will set true positively during the latter portion of P1, hence will be true at the end of TR1. In the third instance, 112 will be reset by 113 at PO·PS time and will remain false at the end of TR1. Thus flip-flop 80 is clocked true at TS1·PD time only if there are no note generators operating in lower octave intervals. With 80 true, flip-flop 74 is closed true when the X1 divider reaches the zero state, i.e., with the rise of $\overline{F}$, and is reset with the fall of XS1 about 28μs later. During this 28μs switch 110 is closed at least twice to transmit multiplexed samples of the synchronizing pulse produced by 74 to SNX. If there are one or more generators operating in lower octave intervals, there is a pulse on $\phi$NX subsequent to $\phi$S1 which resets 112 during TR1; hence 80 is not clocked true and no synchronizing pulse is generated.

Envelope Generator

The envelope generator shown schematically in FIG. 4 is one of seven identical circuits in a set of note generators. The attack 45, decay 46, sustain 7*c*, and release 47 controls are common to both sets associated with one manual. Musical tone envelopes are generally expotential, hence are commonly generated using RC circuits. Varying the time constants in a number of RC circuits simultaneously can be done conveniently by providing a common set of variable resistors and connecting them sequentially to capacitors in the individual circuits by analog switches at an ultrasonic rate, as taught in my copending applications. The VS1 signal, which is the ultrasonic multiplex signal for NG1, has a maximum duration of 3.75μs and a repetition rate of 17.9 khz, as shown for signal V1 in FIG. 7. The other six note generators in the "A" set are assigned intervals V2–V7. The "B" set of note generators is assigned the same intervals; but they are all shifted 28μs with respect to the "A" set by the set-up logic, as noted previously. The VS1 signal serves an additional purpose and to this end the V1 signal is combined with a selected one of five of the signals, shown in FIG. 6, by the octave register and selection logic in Control-1. Notes in octave intervals $\phi 1$–$\phi 4$ are assigned signals VA, VC, VE and VG, respectively, in NG1–NG3. The note generators assigned to notes G-C, i.e., NG4–NG6, are assigned VB, VD, VF and VH. For the highest octave, $\phi 5$, all six note generators are assigned VJ. The latter signal is 0.25μs less than the available 4μs multiplex channel width to provide a guard band between channels.

The envelope generation will now be briefly described with reference to FIG. 4. The desired envelope waveform is developed across capacitor 49, having a value in the order of 0.1μf, which is initially shunted cyclically by switch 50 and resistor 47. The free terminal of 49 is consequently initially at ground. Switch 50 is turned off continuously and 51 is turned on cyclically in response to depression of a playing key. Capacitor 49 charges towards 1.0 volts with a time constant proportional to the resistance setting of 45 and inversely proportional to the duty cycle of VS1. When the charge on 49 reaches 0.5 volts comparator 52 triggers, setting flip-flop 89 which causes switch 51 to be turned off continuously and 53 to be turned on cyclically. Capacitor 49 now discharges toward the sustaining level voltage, established at junction 54 by the sustain level control *7c*, with a time constant determined by the resistance setting of 46 and duty cycle of VS1. If the sustain level is 0.0 volts, a percussive envelope results. When the key is released, switch 53 is turned off continuously and 50 is turned on cyclically to discharge 49 from the sustain level to 0.0 volts with a time constant determined by the resistance setting of 47 and the duty cycle of VS1. The operation of the logic circuits to control the switches 50, 51 and 53 as described in the foregoing is believed to be self-evident with one exception. The purpose of the $\overline{CL1}$ signal connection to gate 114 is to prevent the envelope waveform from starting before the dividers in case they are being held at zero awaiting synchronization with a harmonically related divider already in operation.

The envelope waveform developed across 49 is coupled by a voltage controlled amplifier, or VCA, 63 to the output bus +EN1 through diode 66. Amplifier 63 is trimmed so that its output is normally zero or slightly negative. The diode 66 prevents developing any negative output on +EN1, which would result in an initial non-zero output. The operational amplifier 67 is connected as a unity gain inverting amplifier so as to produce at the cathode of diode 68 a mirror image of the signal at the anode of diode 66. 67 is trimmed to obtain a normal output that is zero or slightly positive. The comparator 70 connected to the VCA output is biassed to trigger at about 0.01 volts, hence output $\overline{HD1}$ goes false at the outset of the envelope signal and remains false until the output +EN1 has fallen practically to zero. The $\overline{HD1}$ signal keeps the dividers in NG1 running until the audio output signal has dropped to a practically inaudible level.

The gain of VCA 63 varies linearly with the voltage on lead AG1, which is proportional to the average velocity of the playing key while it is being depressed. The amplifier gain vs key travel time is shown in a logarithmic plot in FIG. 5. The dashed curve is the characteristic of the RC analog method of touch response control described in my copending applications. It is difficult to control the key velocity with sufficient accuracy to obtain a useful dynamic range greater than 20db with the previous circuit. The useful range of the improved circuit is determined by the precision and range of the digital timer, hence is virtually unlimited.

Keyers

Referring now to FIG. 8, the +EN1 and −EN1 busses from the envelope generator feed several square wave keyers (16' and 8' not shown) and a 4' sawtooth wave keyer. The square wave keyers are exemplified by the 4' fundamental part of the sawtooth synthesizer-keyer. These busses also feed a pair of ladder networks 115, which include switches controlled by the octave register, to provide output signals on +EN1*a* and −EN1*a* that increase, in absolute amplitude, in steps of 6db/octave to compensate for the 6db/octave attenuation of the integrating preamps. such as 10, connected to the outputs of the sine wave keyers.

The fundamental section of all the keyers is the same and comprises a pair of analog switches, such as 32 and 33, connected to the busses +EN1 and −EN1, or +EN1*a* and −EN1*a*, respectively, and a series resistor connected between the junction of the switches and a summing junction, such as 31. In the case of the square wave keyers the summing junction connects directly to a preamp input, which is common to all note generators associated with one manual. In the case of the synthesizer-keyers, i.e., sawtooth and sine wave keyers, the summing junction is connected to different taps on a resistive divider, such as 116, by switches, such as 117, driven by gates such as 118, which are controlled by exclusive-or outputs from the dividers. FIG. 9 shows the output signal waveforms (open loop) produced by the dual keyer shown in FIG. 8 together with the four inputs from the dividers needed to synthesize both waveforms.

When only one pair of switches, such as 32 and 33, is provided for the fundamental, or polarity, section of the keyer; there is a non-uniform load on the envelope busses which would cause cross-modulation between keyers if not eliminated by shunt capacitors, as described in my copending applications. Since such capacitors cannot be integrated, additional pins are required to connect external capacitors. In the improved circuit the need for these capacitors has been eliminated by the provision of a second pair of analog switches, such as 119 and 120, which connect a dummy load to the busses in complementary manner to 32 and 33 so as to eliminate the load fluctuations.

When the dividers first start, the envelope inputs +EN1 and −EN1 are at ground. The keyer outputs, such as 31, are also at ground, hence the alternate operations of a pair of switches, such as 32 and 33, produces no output signal intially. As the envelope signals rise, i.e., in absolute magnitude, a proportional alternating current of square waveform flows through the series 100K resistor to the summing junction. The waveform produced at the outputi by the synthesizer switches is independent of the envelope amplitude.

Although the invention has been described and illustrated in detail, it is to be understood that the same is by way of illustration and example only, and is not to be taken by way of limitation. The spirit and scope of the invention is limited only by the terms of the appended claims.

What is claimed is:

1. In a musical instrument, a playing key having a pair of contacts operated in sequence while the key is being depressed, a digital timer operated during the interval between the contact operations, a voltage controlled amplifier operative to control the amplitude of a tone signal produced in response to operation of said key, a digital-to-analog converter connected between said timer and said amplifier to vary the tone signal amplitude in accordance with the velocity of said key, an envelope generator connected to said voltage controlled amplifier to modulate the tone signal amplitude, said envelope generator comprising a capacitor, a charging circuit for said capacitor operated in response to operation of a playing key to create the attack portion of the envelope, a first discharge circuit for said capacitor operated to create the decay portion of the envelope, a variable voltage source connected in said first discharge circuit to control the envelope signal amplitude during the sustain portion, a second discharge circuit for said capacitor operated in response to release of the playing key to create the release portion of the envelope, an electronic switch operative to control current flow in at least one of said discharge circuits, and a variable duty cycle pulse source connected to a control input of said switch to control the capacitor discharge time.

2. In a musical instrument, an envelope generator, a plurality of keyers connected between tone signal sources and an audio output system, a variable gain amplifier connected between said envelope generator and said keyers, a keyboard having a pair of keyswitch contacts for each key that are operated sequentially by the playing key, a digital timer and a digital-to-analog converter controlled by said keyswitch contacts on an associated playing key to vary the gain of said amplifier in accordance with the key velocity during depression, said envelope generator comprising a capacitor and circuits for varying its charge, a gating circuit operative to charge said capacitor to a predetermined potential in response to operation of a playing key, an electronic switch operative to control current flow in a discharge path for said capacitor, and a variable duty cycle pulse source connected to a control input of said switch to a control input of said switch to control the discharge time of the capacitor.

3. In a musical instrument, an envelope generator, a plurality of keyers connected between tone signal sources and an audio output system, a variable gain amplifier connected between said envelope generator and said keyers, a keyboard having a pair of keyswitch contacts for each key that are operated sequentially by the playing key, a digital timer and a digital-to-analog converter controlled by said keyswitch contacts on an associated playing key to vary the gain of said amplifier in accordance with the key velocity during depression, said envelope generator comprising a capacitor, and an analog switch operative to control current flow in a circuit path for said capacitor, and an ultrasonic pulse source having a variable duty cycle operating said switch to control the time constant of the envelope.

4. A musical instrument as claimed in claim 3 including means for varying the duty cycle of said pulse source in inverse relation to the pitch of a selected note.

5. In a musical instrument, a playing key having a pair of contacts operated in sequence while the key is being depressed, a digital timer operated during the interval between the contact operations, a voltage controlled amplifier operative to control the amplitude of a tone signal produced in response to operation of said key, a digital-to-analog converter connected between said timer and said amplifier to vary the tone signal amplitude in accordance with the velocity of said key, an envelope generator connected to said voltage controlled amplifier to modulate the tone signal amplitude in accordance with the charge on a capacitor, an analog switch operative to control current flow in a circuit path for said capacitor, and an ultrasonic pulse source having a variable duty cycle operating said switch to control the time constant of the envelope.

6. A musical instrument as claimed in claim 5 including means for varying the duty cycle of said pulse source in inverse relation to the pitch of a selected note.

* * * * *

UNITED STATES PATENT AND TRADEMARK OFFICE

CERTIFICATE OF CORRECTION

PATENT NO. : 4,083,286

DATED : April 11, 1978

INVENTOR(S) : Alfred H. Faulkner

It is certified that error appears in the above-identified patent and that said Letters Patent are hereby corrected as shown below:

The title page should be deleted to appear as per attached ATTACHMENT A.

Sheet 1 of the drawings should be deleted to appear as per attached ATTACHMENT B.

Signed and Sealed this

*Twenty-fifth* Day of *September 1979*

[SEAL]

*Attest:*

*Attesting Officer*

LUTRELLE F. PARKER

*Acting Commissioner of Patents and Trademarks*

ATTACHMENT A

United States Patent [19]

Faulkner

[11] 4,083,286

[45] Apr. 11, 1978

[54] ELECTRONIC ORGAN KEYING SYSTEMS

[76] Inventor: Alfred H. Faulkner, 1324 Portesuello Ave., Santa Barbara, Calif. 93105

[21] Appl. No.: 675,853

[22] Filed: Apr. 12, 1976

[51] Int. Cl.[2] ..... G10H 1/02

[52] U.S. Cl. ..... 84/1.26; 84/1.13; 84/1.01; 84/1.24

[58] Field of Search ..... 84/1.01, 1.03, 1.12, 84/1.13, 1.24, 1.26

[56] References Cited

U.S. PATENT DOCUMENTS

| | | | |
|---|---|---|---|
| 3,516,321 | 6/1970 | Harris | 84/1.13 |
| 3,819,844 | 6/1974 | Isii | 84/1.26 |
| 3,969,965 | 7/1976 | Clark, Jr. et al. | 83/1.26 |
| 3,999,457 | 12/1976 | Michel | 84/1.13 X |
| 4,014,238 | 3/1977 | Southard | 84/1.13 |

*Primary Examiner*—Ulysses Weldon

[57] ABSTRACT

The circuits described herein are particularly applicable to organs using multiple pitch divider type note generators that are implemented in LSI form, since one of the aims of the improvements is to reduce the pin count of the LSI chips required in these organs. One such circuit is a synchronizing system used to phase corresponding notes generated in different chips over a single multiplexed buss. Another multiplexed buss is used to identify the lowest octave in use for each note of the chromatic scale. A new touch response circuit employs a digital to analog converter to eliminate the need for capacitors used in previously described fully analog type circuits thereby eliminating many pins. This circuit furthermore enables a superior relation of key velocity to signal level to be obtained which makes practical a wider dynamic gradation of sound. A new digital mechanization of the debounce filters used to overcome chatter of the keyboard contacts eliminates the need for filter capacitors previously employed, thereby saving many pin connections. A new keyer circuit synthesizes sine waves with fewer high value resistors, eliminates the need for filter capacitors to prevent cross modulation, and enables both sine waves and saw tooth waves to be synthesized with a common set of logic elements. Lastly, an improved envelope generator changes the effective envelope time constants inversely with the pitch of the selected note by means of variable duty cycle charging circuits.

6 Claims, 9 Drawing Figures

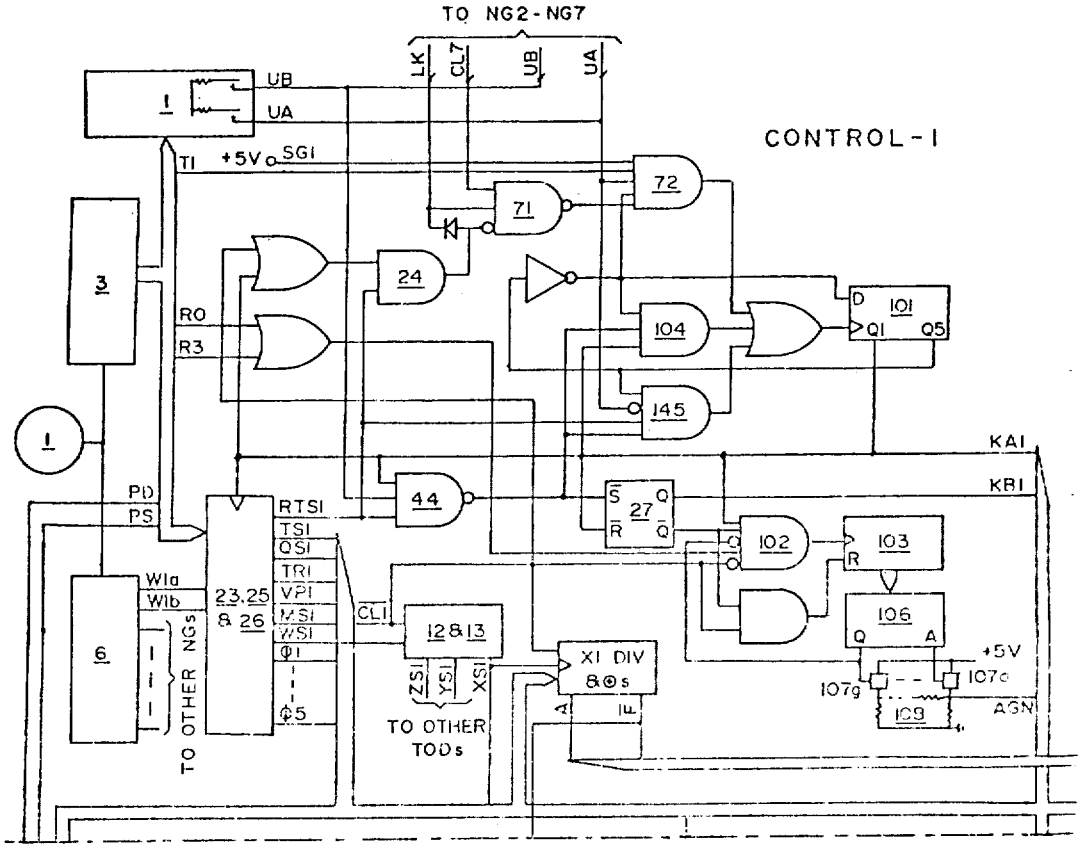

CONTROL-1

SYNCHRONIZER-1